US010879023B1

(12) United States Patent
Boudreau, Jr. et al.

(10) Patent No.: US 10,879,023 B1
(45) Date of Patent: Dec. 29, 2020

(54) PROGRESSIVELY CONTACTING SWITCH

(71) Applicant: Landis+Gyr Innovations, Inc., Alpharetta, GA (US)

(72) Inventors: Frank J. Boudreau, Jr., Otterbein, IN (US); Matt E. Kraus, Jamestown, IN (US)

(73) Assignee: Landis+Gyr Innovations, Inc., Alpharetta, GA (US)

( * ) Notice: Subject to any disclaimer, the term of this patent is extended or adjusted under 35 U.S.C. 154(b) by 0 days.

(21) Appl. No.: 16/438,713

(22) Filed: Jun. 12, 2019

(51) Int. Cl.
*H01H 1/025* (2006.01)
*H01H 33/02* (2006.01)

(52) U.S. Cl.
CPC ..... *H01H 33/025* (2013.01); *H01H 1/025* (2013.01); *H01H 2205/002* (2013.01)

(58) Field of Classification Search
CPC ..... H01H 1/025; H01H 1/2016; H01H 1/56; H01H 2001/2033; H01H 33/025; H01H 9/38; H01H 1/385; H01H 1/021; H01H 33/12; H01H 59/0009
USPC ..... 218/16, 146, 17, 18, 20, 21; 200/244, 200/263, 401; 335/132
See application file for complete search history.

(56) References Cited

U.S. PATENT DOCUMENTS 3,158,721 A * 11/1964 Delaney ..... H01H 9/386 218/16
3,218,428 A * 11/1965 Gauthier ..... H01H 1/226 200/251
3,238,339 A * 3/1966 Fehling ..... H01H 1/22 218/16
4,680,562 A * 7/1987 Bratkowski ..... H01H 71/2418 335/16
4,713,504 A * 12/1987 Maier ..... H01H 9/383 218/21
4,926,018 A * 5/1990 Buxton ..... H01H 9/383 218/20
5,296,664 A * 3/1994 Crookston ..... H01H 71/501 200/401
6,194,984 B1 * 2/2001 Kappel ..... H01H 50/546 218/152

(Continued)

FOREIGN PATENT DOCUMENTS

DE 9404775 U1 6/1994
EP 1962316 * 8/2008 ..... H01H 50/64

(Continued)

OTHER PUBLICATIONS

Translation og FR2686448 (original doc. published Jul. 23, 1993) (Year: 1993).*

(Continued)

*Primary Examiner* — William A Bolton
(74) *Attorney, Agent, or Firm* — Kilpatrick Townsend & Stockton LLP

(57) ABSTRACT

A progressively contacting switch includes a set of contacts connected to an input. The set includes a first sacrificial contact formed of a first metal and a first conducting contact formed of a second metal. The switch further includes a movable set of contacts connected to an output. The movable set includes a second sacrificial contact formed of the first metal and a second conducting contact formed of the second metal. The switch includes an element configurable to connect the movable set of contacts such that the first sacrificial contact connects to the second sacrificial contact at a first time, thereby causing a current to flow from the input to the output, and while the first sacrificial contact remains connected to the second sacrificial contact, the first conducting contact connects with the second conducting contact at a later time.

18 Claims, 7 Drawing Sheets

(56) References Cited

U.S. PATENT DOCUMENTS

| | | | | |
|---|---|---|---|---|
| 6,784,385 | B2 * | 8/2004 | Hernandez-Perez | H02B 1/03 200/50.33 |
| 7,990,239 | B2 * | 8/2011 | Brown | H01H 1/54 335/106 |
| 8,658,921 | B2 * | 2/2014 | Therrien | H01H 1/26 200/52 R |
| 8,941,269 | B1 * | 1/2015 | Flegel | H01H 83/18 307/115 |
| 2008/0073327 | A1 * | 3/2008 | Annis | H01H 9/446 218/36 |

FOREIGN PATENT DOCUMENTS

| | | | | |
|---|---|---|---|---|
| EP | 2474989 | A2 | 6/2012 | |
| FR | 2686448 | * | 7/1993 | H01H 9/38 |
| FR | 2691574 | A1 | 11/1993 | |
| JP | S58-034329 | U | 5/1983 | |

OTHER PUBLICATIONS

"Arc Erosion of Electrical Contacts", Platinum Metals Review, vol. 1, No. 2, 1957, p. 57.

"Relay Contact Life", Tyco Electronics Corporation, Admitted Prior Art, 3 pages.

Pons , "Electrical Contact Material Arc Erosion: Experiments and Modeling Towards the Design of an AgCdO Substitute", May 2010, 139 pages.

PCT Patent Application No. PCT/US2020/036403, International Search Report and Written Opinion, dated Sep. 8, 2020, 16 pages.

* cited by examiner

PROGRESSIVELY CONTACTING SWITCH

TECHNICAL FIELD

This invention relates generally to switches used to connect and disconnect electric circuits. In an example, this invention relates to a progressively contacting switch that uses a combination of sacrificial and conducting contacts to improve reliability and performance.

BACKGROUND

Switches can connect and disconnect electric circuits by causing contacts to close or open. But when large amounts of current flow through switches, arcs of electric current can form during opening and closing, causing the contacts to heat up (ohmic heating) and plasma to be deposited on the contact. Over time, through repeated opening and closing, the contacts can wear down and form a thin bridge, causing an increase in impedance. This increase in impedance causes unnecessary heat, damages components, and interferes with power transmission.

Hence, new solutions are needed that improve the reliability and conductivity of switches.

SUMMARY

Certain aspects and features include an electrical switch. The switch includes a movable set of contacts connected to an input. The movable set of contacts include a first sacrificial contact formed of a first metal and a first conducting contact formed of a second metal. The switch includes a set of contacts connected to an output. The set of contacts includes a second sacrificial contact formed of the first metal and a second conducting contact formed of the second metal. The switch further includes an element configurable to connect the movable set of contacts such that the first sacrificial contact connects with the second sacrificial contact at a first time, thereby causing a current to flow from the input to the output, and while the first sacrificial contact remains connected to the second sacrificial contact, the first conducting contact connects with the second conducting contact at a second time that is after the first time.

These illustrative examples are mentioned not to limit or define the disclosure, but to provide examples to aid understanding thereof. Additional examples and further description are provided in the Detailed Description.

BRIEF DESCRIPTION OF THE FIGURES

These and other features, aspects, and advantages of the present disclosure are better understood when the following Detailed Description is read with reference to the accompanying drawings, where.

DETAILED DESCRIPTION

Aspects of the present disclosure include a progressively contacting switch. Non-limiting examples of a switch include a contactor and a relay. The progressively contacting switch prevents early erosion of switch contacts by providing a sacrificial set of contacts that closes before a normal set of contacts closes. The sacrificial contacts, which are more durable in nature than the normal set of contacts, make initial contact when the switch closes and are more resilient to current arcing and resulting high temperatures. As a result, the progressively contacting switch can last longer than existing switches. Further, by reducing generated heat, a smaller relay or contactor with less copper, silver, or other rare metals may possible, thereby reducing cost.

Applications of the progressively contacting switch include, but are not limited to power delivery systems, high current relays, contactors, switches, and electric meters. For example, electric meters using the progressive switch benefit from a lower amount of generated heat, improved performance, and longer equipment lifespan. The progressively contacting switch allows improvement in a maximum number of switch closures before failure. In contrast, each closing of a switch in the current solutions results in a degradation of the contact that ultimately leads to premature failure.

The progressively contacting switch includes two sets of contacts. Each set of contacts includes a sacrificial contact connected to a conducting contact. The sacrificial contacts can be constructed of an electrically conductive material that is durable and resistant to heat caused by arc erosion. The conducting contacts can be constructed of a material that has a high electrical conductivity. When the switch is closed, the two sets of contacts connect to each other such that the sacrificial contacts make contact with each other first, thereby bearing the bulk of any electrical arcing and heat. Once the two sacrificial contacts have made contact, the two conducting contacts connect with each other, conducting the bulk of the current with lower impedance due to the higher conductivity of the conducting contacts relative to the sacrificial contacts.

Figure 1:
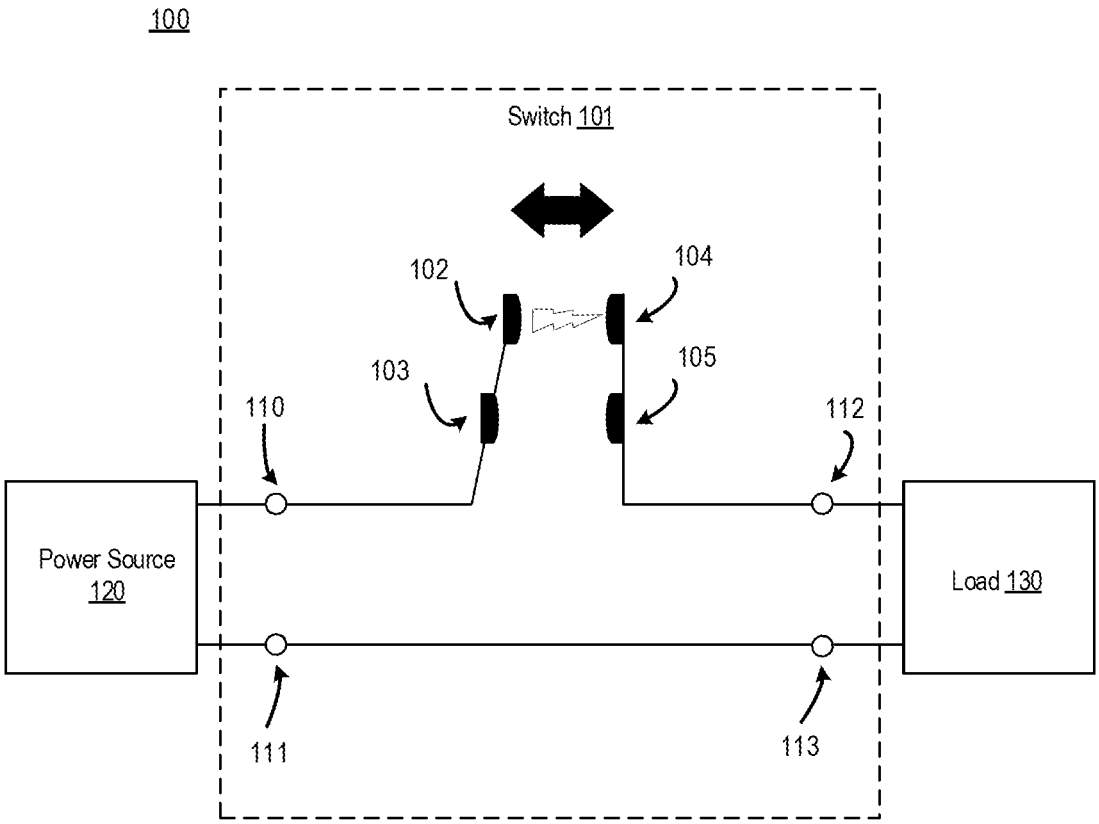
FIG. 1 illustrates an example of a progressively contacting switch, according to an aspect of the present disclosure.
Figure 7:
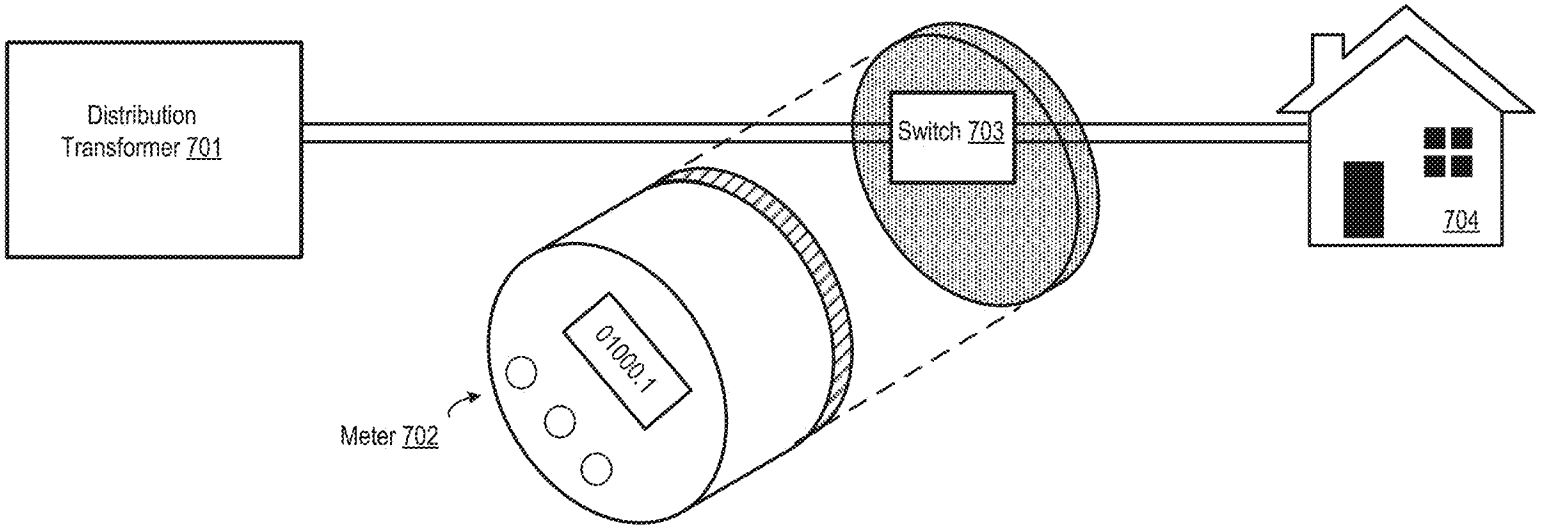
FIG. 7 illustrates another example of the switch environment, according to an aspect of the present disclosure.

Turning now to the Figures, FIG. 1 illustrates an example of a progressively contacting switch, according to an aspect of the present disclosure. FIG. 1 depicts switch environment 100, which includes switch 101, power source 120, and load 130. Switch 101 can connect or disconnect power source 120 from load 130. Examples of power sources include distribution transformers, generators, and batteries. Examples of loads include customer premises, lights, and mechanical devices. FIG. 7 illustrates another example of the switch environment, according to an aspect of the present disclosure. FIG. 7 includes a distribution transformer 701 as the power source an a switch 703 in an electric meter 702, and a customer premises 704 as the load.

Switch 101 includes connections 110, 111, 112, and 113, sacrificial contacts 102 and 104, and conducting contacts 103 and 105. When switch 101 is closed, connections 110 and 112 are connected. As shown, connection 111 and 113 are always connected. But switch 101 can be configured in a double pole, double throw configuration such that connections 111 and 113 can also be connected or disconnected. Examples of other configurations are single pole, double throw and double pole, double throw.

Sacrificial contacts 102 and 104 and conducting contacts 103 and 105 can be made of different types of metal. For example, while still electrically conductive, sacrificial contacts 102 and 104 can be fabricated from more durable material. By having a higher melting point, sacrificial contacts 102 and 104 can better withstand arcing and heat caused by electricity. Hence, sacrificial contacts 102 and 104 may in some cases be made of a material that has a lower electrical conductivity and/or a higher melting point than the materials which are used to form conducting contacts 103 and 105.

Conducting contacts 103 and 105 can be made of a material that has a high electrical conductivity. In some cases, the material used can have a higher electrical conductivity than the material used for the sacrificial contacts 102 and 104. Examples of suitable materials for conducting contacts 103 and 105 include silver, copper, gold, aluminum, zinc, nickel, brass, bronze, or alloys thereof. Examples of suitable materials for sacrificial contacts 102 and 104 include tungsten, Multilam, aluminum, zinc, nickel, brass, bronze, platinum, steel, lead, and alloys thereof.

The sacrificial contacts and the conducting contacts can be organized into sets. For example, a first set of contacts could include sacrificial contact 102 and conducting contact 103 and a second set could include sacrificial contact 104 and conducting contact 105. For example purposes, two sets are shown, but any number of sets are possible. Further, any number of sacrificial and conducting contacts are possible. For example, in high current applications, each set might have multiple sacrificial and/or conducting contacts.

In an aspect, switch 101 is manually operated. In this case, a user can move an element, actuator, or rocker mechanism to open or close the switch. In turn, the mechanism opens or closes the sacrificial contacts and the conducting contacts as described herein. One or more sets of contacts can be movable. For example, a first pair of contacts that includes sacrificial contact 102 and conducting contact 103 can be moveable whereas a second pair of contacts that includes sacrificial contact 104 and conducting contact 105 that are fixed, or vice versa. In some cases, both more than one set of contacts.

Switch 101 can be in an open position, a closed position, or in transition between open and closed positions. For example, in an open position, no contacts are connected, and no current flows between connection 110 and 112. As the switch 101 is closed, the switch 101 enters a transition in which sacrificial contact 102 connects with sacrificial contact 104, causing current to flow between connections 110 and 112 via sacrificial contacts 102 and 104. When in transition, conducting contacts 102 and 104 are not connected.

In the closed position, sacrificial contacts 102 and 104 are connected and conducting contacts 103 and 105 are also connected. In the closed position, the current flows between connection 110 and connection 112 in one or more paths. For example, current can flow via sacrificial contacts 102 and 104 and also between conducting contacts 103 and 105. In some cases, a majority of a total current flows between the conductive contacts 103 and 105. The closing and opening of switch 101 is discussed further with respect to FIGS. 2-4.

When switch 101 is in transition or closed position, current can flow from connection 110 to connection 112 or vice versa. Thus, switch 101 can be used for alternating or direct current applications. Further, when switch 101 is in closed position, any current flow can divide across the sacrificial contacts and the conducting contacts.

Figure 6:
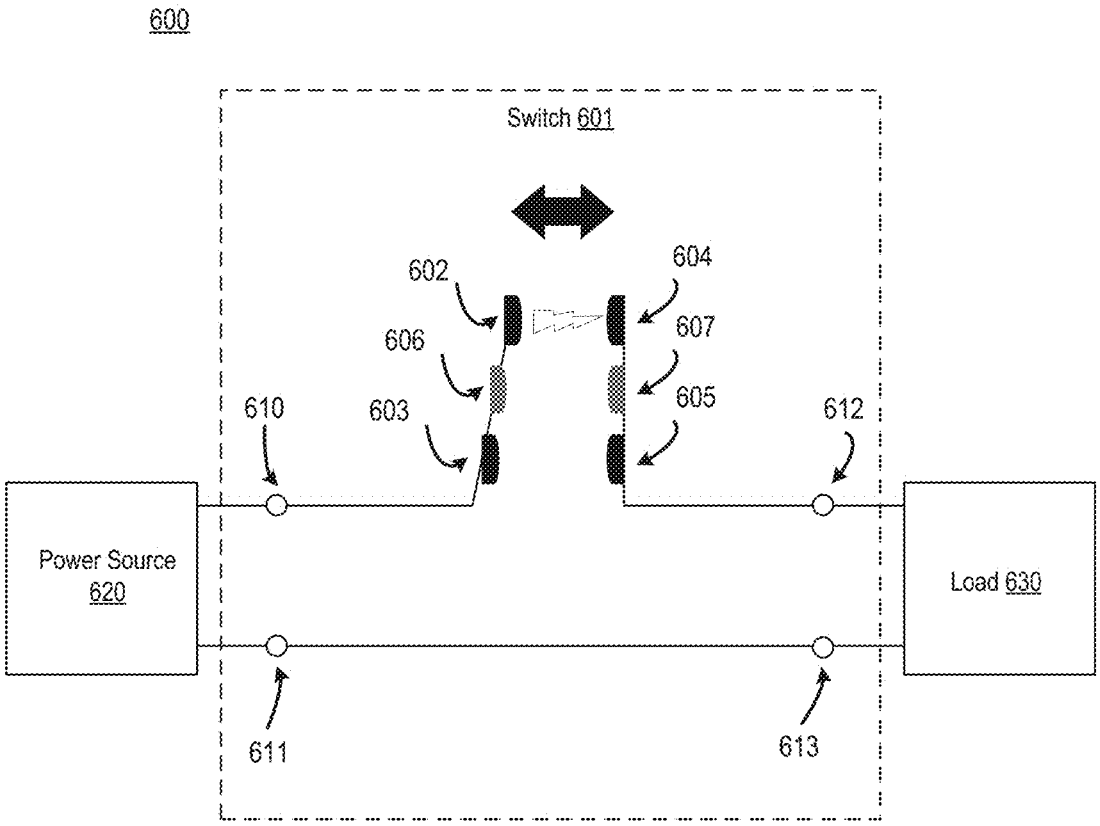
FIG. 6 illustrates an example of a progressively contacting switch, according to an aspect of the present disclosure.

In an aspect, the switch 101 includes an intermediate set of contacts that make contact after the sacrificial contacts but before the conducting contacts. In this case, the sacrificial contacts are the least conductive but are the most robust, the conducting contacts are the most conductive but the least robust, and the intermediate contacts are balanced between being robust and conductive. For example, the intermediate contacts can be less robust but more conductive than the sacrificial contacts and more robust and less conductive than the conducting contacts. FIG. 6 illustrates an example of a progressively contacting switch, according to an aspect of the present disclosure. FIG. 6 includes switch 601, power source 620, and load 630. Switch 601 includes connections 610, 611, 612, and 613; sacrificial contacts 602 and 604; intermediate contacts 606 and 607; and conducting contacts 603 and 605.

Figure 2:
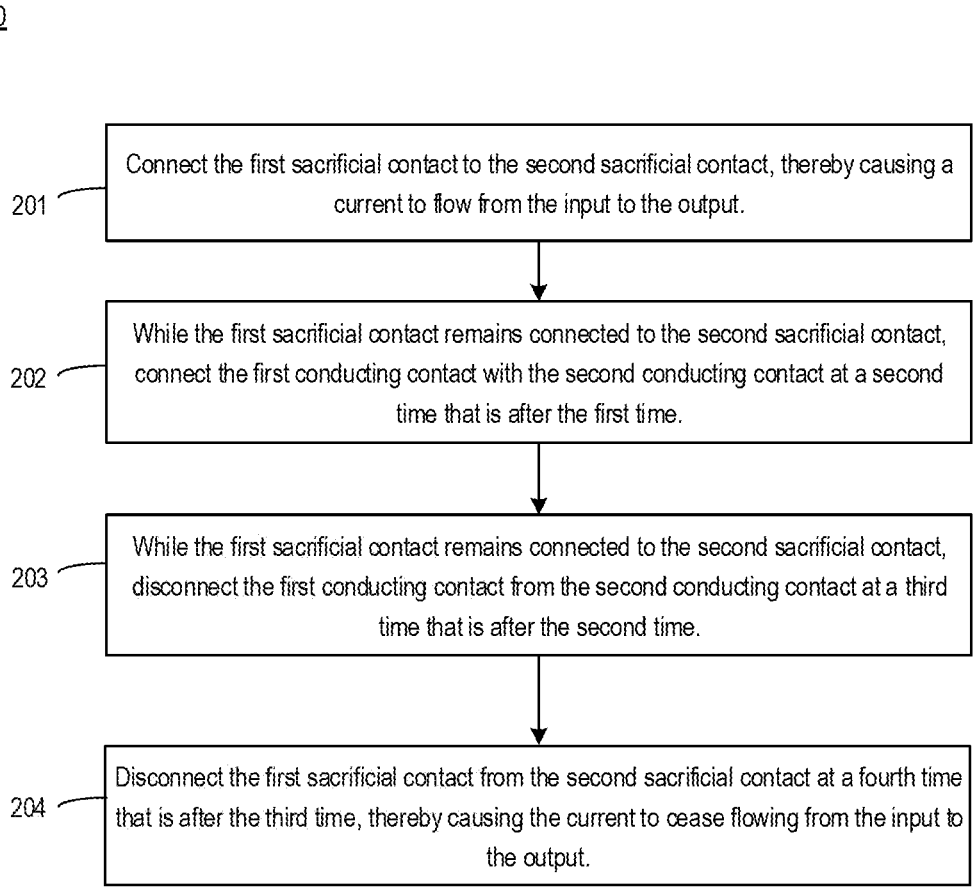
FIG. 2 illustrates an example of a process for closing and opening a progressively contacting switch, according to an aspect of the present disclosure.

FIG. 2 illustrates an example of a process 200 for closing and opening a progressively contacting switch, according to an aspect of the present disclosure. Process 200 can be implemented by an electronic control mechanism that causes a mechanical device to open or close the contacts of switch 101. For discussion purposes, process 200 is discussed with respect to FIGS. 3 and 4.

Figure 3:
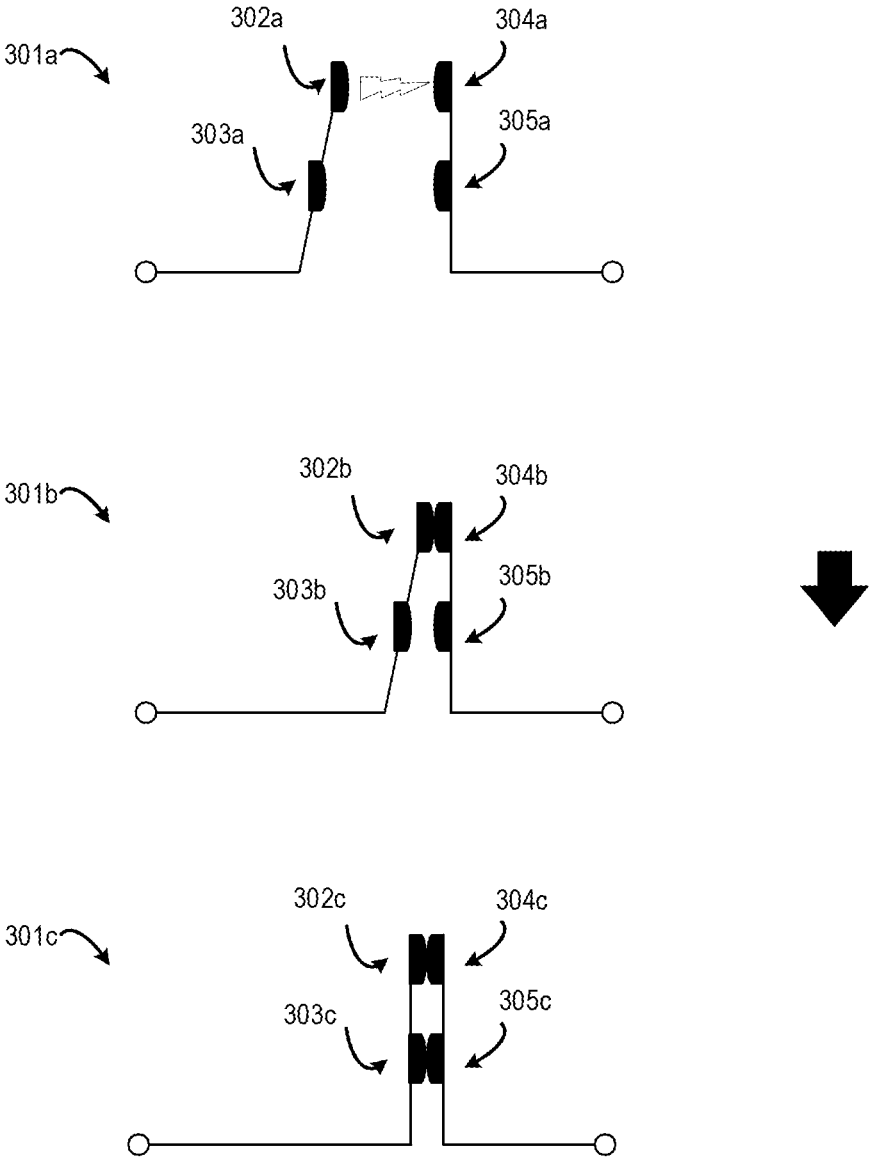
FIG. 3 illustrates an example of a progressively contacting switch moving from the closed to the open position, according to an aspect of the present disclosure.

FIG. 3 illustrates an example of a progressively contacting switch moving from the open to the closed position, according to an aspect of the present disclosure. FIG. 3 depicts switch positions 301*a-c*. Open position 301*a* includes sacrificial contacts 302*a* and 304*a* and conducting contacts 303*a* and 305*a*. Transition position 301*b* includes sacrificial contacts 302*b* and 304*b* and conducting contacts 303*b* and 305*b*. Closed position 301*c* includes sacrificial contacts 302*c* and 304*c* and conducting contacts 303*c* and 305*c*.

Open position 301*a* represents an open state in which no contacts are connected and no current flows through switch 101. Transition position 301*b* represents a transition state in which current flows through the sacrificial contacts 302*b* and 304*b*. Closed position 301*c* represents a closed state in which current flows through both conducting contacts 303*c* and 305*c* and sacrificial contacts 302*c* and 304*c*.

Process 200 assumes that the switch is in open position 301*a*. Sacrificial contacts 302*a* and 304*a* are not connected. Conducting contacts 303*a* and 305*a* are not connected. No current can flow through the switch.

At block 201, process 200 involves connecting the first sacrificial contact to the second sacrificial contact, thereby causing a current to flow from the input to the output. The switch moves from open position 301*a* to transition position 301*b*. In transition position 301*b*, sacrificial contact 302*b* is connected to sacrificial contact 304*b*, which allows current to flow through the switch. But conducting contact 303*b* and conducting contact 305*b* are not connected.

At block 202, process 200 involves connecting the first conducting contact with the second conducting contact at a second time that is after the first time while the first sacrificial contact remains connected to the second sacrificial contact. Accordingly, the switch moves from transition position 301*b* to closed position 301*c*.

In closed position 301*c*, conducting contact 303*b* is connected to conducting contact 305*b* and sacrificial contact 302*b* is connected to sacrificial contact 304*b*. Current flows through the switch via both conducting contacts 303*b*-305*b* and sacrificial contacts 302*b*-304*b*. Because sacrificial contacts 302*a* and 304*a* make contact before conducting contacts 303*b* and 305*b*, sacrificial contacts 302*a* and 302*b*, absorb more of any arcing and minimize the electrical arcing and erosion of conductive contacts 303*b* and 305*b*. The switch may be in closed position 301 for a substantial amount of time before the switch is disconnected.

At block 203, process 200 involves disconnecting the first conducting contact from the second conducting contact at a third time that is after the second time while the first sacrificial contact remains connected to the second sacrificial contact. Blocks 203 and 204 are discussed with respect to FIG. 4.

Figure 4:
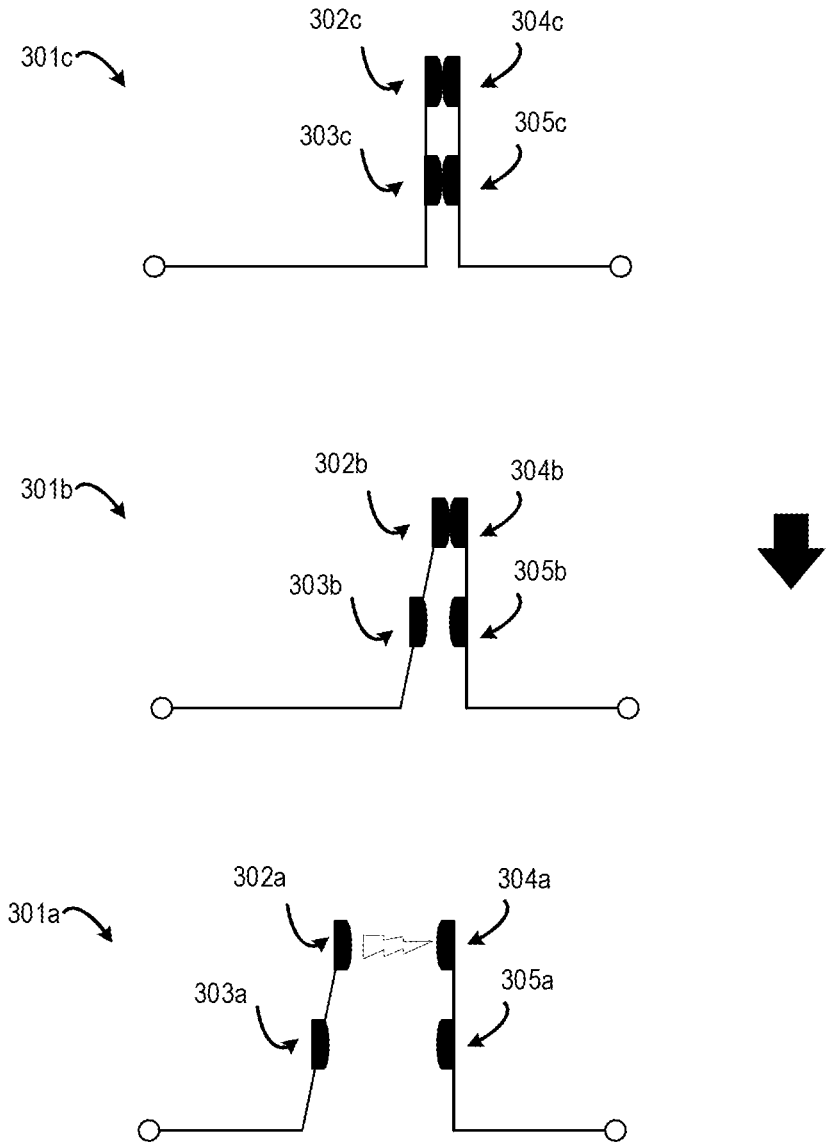
FIG. 4 illustrates an example of a progressively contacting switch moving from the open to the closed position, according to an aspect of the present disclosure.

FIG. 4 illustrates an example of a progressively contacting switch moving from the closed to the open position, according to an aspect of the present disclosure. FIG. 4 depicts switch positions 301*a-c* as depicted in FIG. 3. Returning to FIG. 2, at block 203, the switch is at transition position 301*b*. In transition position 301*b*, sacrificial contact 302*b* is connected to sacrificial contact 304*b*, which allows current to flow through the switch.

At block 204, process 200 involves disconnecting the first sacrificial contact from the second sacrificial contact at a fourth time that is after the third time, thereby causing the current to cease flowing from the input to the output. At block 204, the switch returns to open position 301*a*.

Figure 5:
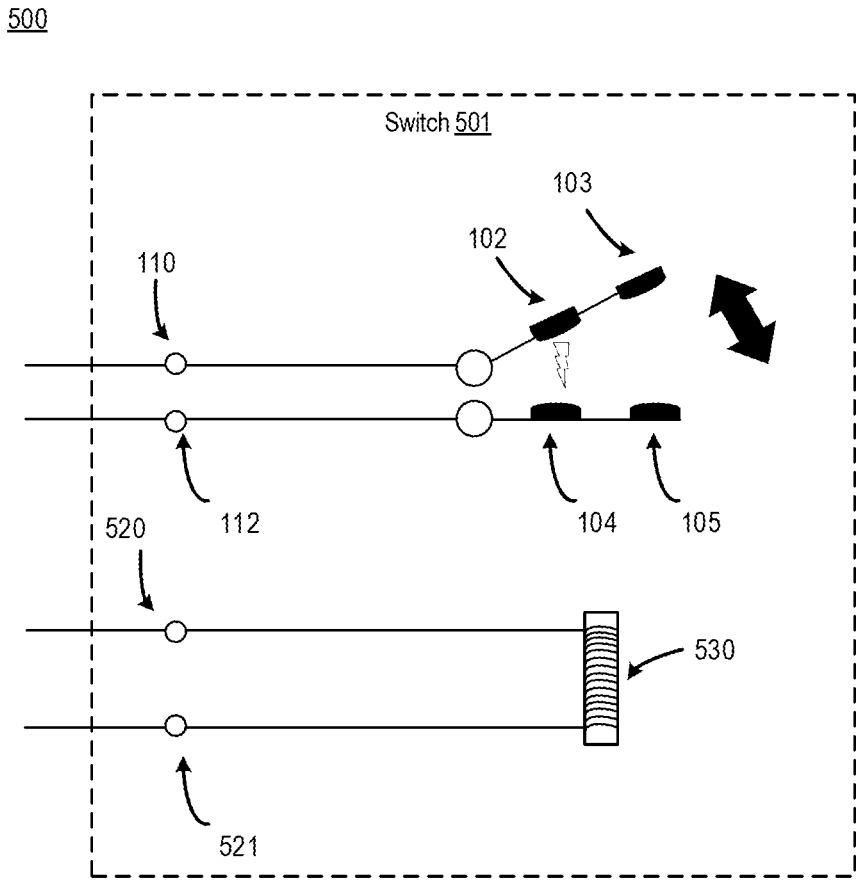
FIG. 5 illustrates an example of an electrically-controlled progressively contacting switch, according to an aspect of the present disclosure.

In another aspect, as depicted in FIG. 5, the switch is controlled by an externally-generated electrical signal.

FIG. 5 illustrates an example of an electrically-controlled progressively contacting switch, according to an aspect of the present disclosure. FIG. 5 depicts switch environment 500, which includes progressively contacting switch 501, which includes sacrificial contacts 102 and 104, conducting contacts 103 and 105, connections 110 and 112, relay coil 530, and control contacts 520-521.

In an example, when a voltage signal is applied between contacts 520 and 521, relay coil is activated and causes a magnetic field, which in turn moves the switch such that the sacrificial contacts and conducting contacts operate consistently as described with respect to FIGS. 1-4.

Switch 501 can be in a default-open or default-closed position. Switch 501 is configured such that an electromagnetic field generated in relay coil 530 causes switch 501 to move from an open to a closed position or from a closed to an open position. In other aspects, switch 501 can receive one or more control signals. For example, a first control signal can cause switch 501 to close and a second control signal can cause switch 501 to open. Alternatively, switch 501 can default in either closed or open state, and a presence of a control signal can change the state from open to closed or closed to open.

While the present subject matter has been described in detail with respect to specific aspects thereof, it will be appreciated that those skilled in the art, upon attaining an understanding of the foregoing, may readily produce alterations to, variations of, and equivalents to such aspects. Accordingly, it should be understood that the present disclosure has been presented for purposes of example rather than limitation and does not preclude inclusion of such modifications, variations, and/or additions to the present subject matter as would be readily apparent to one of ordinary skill in the art.

What is claimed is:

1. An electric meter comprising:
an input connected to a power source;
an output connected to an electrical load;
a second input connected to the power source;
a second output connected to the electrical load;
an electrical switch comprising:
a movable set of contacts connected to the input and comprising:
a first sacrificial contact formed of a first metal; and
a first conducting contact formed of a second metal; and
a set of contacts connected to the output and comprising:
a second sacrificial contact formed of the first metal; and
a second conducting contact formed of the second metal;
an element that is configurable to connect the movable set of contacts with the set of contacts such that:
the first sacrificial contact connects with the second sacrificial contact at a first time, thereby causing a current to flow, via the first sacrificial contact and the second sacrificial contact, from the power source to the electrical load,
while the first sacrificial contact remains connected to the second sacrificial contact, the first conducting contact connects with the second conducting contact at a second time that is after the first time, causing an additional current to flow, via the first conducting contact and the second conducting contact, from the power source to the electrical load; and
a connector connecting the second input to the second output, wherein the connector connects the second input to the second output independent of a state of the movable set of contacts relative to the set of contacts.

2. The electrical switch of claim 1, wherein the element is further configurable to disconnect the movable set of contacts such that:
while the first sacrificial contact remains connected to the second sacrificial contact, the first conducting contact disconnects from the second conducting contact at a third time that is after the second time, and
the first sacrificial contact disconnects from the second sacrificial contact at a fourth time that is after the third time, thereby causing the current to cease flowing from the input to the output.

3. The electrical switch of claim 1, wherein the additional current is greater than the current.

4. The electrical switch of claim 1, wherein the first metal comprises a first electrical conductivity and the second metal comprises a second electrical conductivity that is greater than the first electrical conductivity.

5. The electrical switch of claim 1, wherein the first metal comprises a first melting point and the second metal comprises a second melting point that is lower than the first melting point.

6. The electrical switch of claim 1, wherein the first metal is an alloy comprising tungsten and the second metal is an alloy that comprises one or more of silver or copper.

7. An electrical switch for an electric meter, comprising:
a set of contacts connected to an input and comprising:
a first sacrificial contact formed of a first metal;
a first conducting contact formed of a second metal; and
a first intermediate contact formed of a metal other than the first metal and the second metal; and
a movable set of contacts connected to an output and comprising:
a second sacrificial contact formed of the first metal;
a second conducting contact formed of the second metal; and
a second intermediate contact formed of the metal other than the first metal and the second metal; and
an element that is configurable to connect the movable set of contacts with the set of contacts such that:
the second sacrificial contact connects with the first sacrificial contact at a first time, thereby causing a current to flow from the input between the first sacrificial contact and the second sacrificial contact to the output, the first intermediate contact connects with the second intermediate contact at a second time that is after the first time, thereby causing a second current to flow between the first intermediate contact and the second intermediate contact from the input to the output, and while the second sacrificial contact remains connected to the first sacrificial contact and the second intermediate contact remains connected to the first intermediate contact, the second conducting contact connects with the first conducting contact at a third time that is after the second time.

8. The electrical switch of claim 7, wherein the element is further configurable to disconnect the movable set of contacts such that:

while the first sacrificial contact remains connected to the second sacrificial contact and the first intermediate contact remains connected to the second intermediate contact, the first conducting contact disconnects from the second conducting contact at a fourth time that is after the third time, while the first sacrificial contact remains connected to the second sacrificial contact, the first intermediate contact disconnects from the second intermediate contact at a fifth time that is after the fourth time, and the first sacrificial contact disconnects from the second sacrificial contact at a sixth time that is after the fifth time, thereby causing the current to cease flowing from the input to the output.

9. The electrical switch of claim 7, wherein when the first conducting contact connects with the second conducting contact, an additional current flows between the first conducting contact and the second conducting contact.

10. The electrical switch of claim 7, wherein the first metal comprises a first electrical conductivity, the second metal comprises a second electrical conductivity that is greater than the first electrical conductivity, and wherein the metal other than the first metal and the second metal comprises an electrical conductivity that is greater than the first electrical conductivity but less than the second electrical conductivity.

11. The electrical switch of claim 7, wherein the first metal comprises a first melting point, the second metal comprises a second melting point that is lower than the first melting point, and the metal other than the first metal and the second metal comprises a melting point that is lower than the first melting point and higher than the second melting point.

12. The electrical switch of claim 7, wherein the first metal is an alloy comprising tungsten and the second metal is an alloy that comprises one or more of silver or copper.

13. An electrically-controllable switch for an electric meter, comprising:

an input connected to a power source;

an output connected to an electrical load;

a movable set of contacts connected to the input and comprising:

a first sacrificial contact formed of a first metal comprising tungsten;

a first conducting contact formed of a second metal comprising one or more of silver or copper; and a set of contacts connected to the output and comprising:

a second sacrificial contact formed of the first metal; and a second conducting contact formed of the second metal;

an element that is configurable to connect the movable set of contacts with the set of contacts; and a control input configured to receive a control signal, where when receiving the control signal, the electric meter causes the element to move the movable set of contacts such that the first sacrificial contact connects with the second sacrificial contact at a first time, thereby causing a current to flow, through the electric meter, via the first sacrificial contact and the second sacrificial contact, from the power source to the electrical load, and while the first sacrificial contact remains connected to the second sacrificial contact, the electric meter causes the element to move the movable set of contacts such that the first conducting contact connects with the second conducting contact at a second time that is after the first time, causing an additional current to flow, through the electric meter, via the first conducting contact and the second conducting contact, from the power source to the electrical load;

a second input connected to the power source;

a second output connected to the electrical load; and a connector connecting the second input to the second output, wherein the connector connects the second input to the second output independent of a state of the movable set of contacts relative to the set of contacts.

14. The electrically-controllable switch of claim 13, further comprising an additional input configured to receive a signal, wherein receiving the signal causes a disconnection of the movable set of contacts.

15. The electrically-controllable switch of claim 13, wherein the element is further configurable to disconnect the movable set of contacts such that:

while the first sacrificial contact remains connected to the second sacrificial contact, the first conducting contact disconnects from the second conducting contact at a third time that is after the second time, and the first sacrificial contact disconnects from the second sacrificial contact at a fourth time that is after the third time, thereby causing the current to cease flowing from the input to the output.

16. The electrically-controllable switch of claim 13, wherein when the first conducting contact connects with the second conducting contact, an additional current flows between the first conducting contact and the second conducting contact.

17. The electrically-controllable switch of claim 13, wherein the first metal comprises a first electrical conductivity and the second metal comprises a second electrical conductivity that is greater than the first electrical conductivity.

18. The electrically-controllable switch of claim 13, wherein the first metal comprises a first melting point and the second metal comprises a second melting point that is lower than the first melting point.

* * * * *